US006997733B2

(12) United States Patent
Peng

(10) Patent No.: US 6,997,733 B2
(45) Date of Patent: Feb. 14, 2006

(54) ELECTRICAL CONNECTOR ASSEMBLY WITH SHROUD AND POSITIONING DEVICE

(75) Inventor: Shiao-Bin Peng, Taipei Hsien (TW)

(73) Assignee: Advanced Connectek Inc., Taipei Hsien (TW)

( * ) Notice: Subject to any disclaimer, the term of this patent is extended or adjusted under 35 U.S.C. 154(b) by 0 days.

(21) Appl. No.: 10/920,341

(22) Filed: Aug. 18, 2004

(65) Prior Publication Data

US 2005/0227537 A1 Oct. 13, 2005

(30) Foreign Application Priority Data

Apr. 9, 2004 (TW) ..... 93205458 U

(51) Int. Cl.
*H01R 13/627* (2006.01)

(52) U.S. Cl. ..... 439/353; 439/357

(58) Field of Classification Search ..... 439/607, 439/353, 357–358

See application file for complete search history.

(56) References Cited

U.S. PATENT DOCUMENTS 5,660,558 A * 8/1997 Osanai et al. ..... 439/353
6,257,914 B1 * 7/2001 Comerci et al. ..... 439/357
6,290,530 B1 * 9/2001 Chang ..... 439/378
6,364,687 B1 * 4/2002 Chen ..... 439/358
6,413,112 B1 * 7/2002 Semmeling et al. ..... 439/358
6,595,801 B1 * 7/2003 Leonard et al. ..... 439/607
6,607,397 B1 * 8/2003 Zhang et al. ..... 439/357
6,786,755 B1 * 9/2004 Dambach et al. ..... 439/353
6,913,489 B1 * 7/2005 Chai et al. ..... 439/607
2003/0228788 A1 * 12/2003 Igarashi et al. ..... 439/358

* cited by examiner

*Primary Examiner*—Michael C. Zarroli
(74) *Attorney, Agent, or Firm*—Troxell Law Office, PLLC

(57) ABSTRACT

An electrical connector assembly comprises a shroud and a connector including an insulating body, parallel conductors, two positioning devices, front and rear housings coupled by soldering, a base, upper and lower holding plates, and a plastic case having a top latch for releasably fastening the shroud. The body comprises a forward extension and two sidewalls each including an upper groove extended toward the extension, a lower opening with either positioning device fastened in the upper groove and the lower opening, and two outer recesses with ends of the upper holding plate fastened in the upper recesses and ends of the lower holding plate fastened in the lower recesses. The invention can effect a high quality signal transmission and substantially eliminate EMI during operation.

8 Claims, 4 Drawing Sheets

ELECTRICAL CONNECTOR ASSEMBLY WITH SHROUD AND POSITIONING DEVICE

BACKGROUND OF THE INVENTION

1. Field of the Invention

The present invention relates to electrical connectors and more particularly to an electrical connector assembly including an electrical connector and a HDMI shroud coupled together by snapping.

2. Description of Related Art

Electrical connectors are widely employed in the ends of cables for electrically coupling two electronic devices together for signal communication therebetween. Also, a variety of advanced electronic products such as LCDs (liquid crystal displays) are commercially available as time evolves. Thus, continuing improvements in the exploitation of electrical connector are constantly being sought by the manufacturers for meeting associated electrical requirements. For instance, HDMI (high definition multimedia interface) electrical connectors are newly developed. HDMI connectors have the advantages of DVI (digital video interface) connectors while without its disadvantages. Also, HDMI connectors are greatly reduced in size for being easily adapted to mount in an AV (audio video) product. Thus, it is desirable to provide an improved HDMI electrical connector.

SUMMARY OF THE INVENTION

It is an object of the present invention to provide an electrical connector assembly comprises a shroud and a connector coupled together with the shroud by snapping so as to obtain a good electrical connecting performance during use.

It is another object of the present invention to provide an electrical connector assembly comprises a connector including a front and rear housings coupled by overall type soldering so as to substantially eliminate EMI during operation.

It is yet another object of the present invention to provide an electrical connector assembly comprises a connector including upper and lower holding plates for fastening parallel conductors and two positioning devices at two sidewalls of an insulating body and a parallelepiped base to prevent electrical connector from being loose so as to protect the soldered portions of the conductors and thus effect a high quality signal transmission.

To achieve the above and other objects, the present invention provides an electrical connector assembly comprising a shroud and a connector including an insulating body, a plurality of parallel first conductors, two positioning devices, a front housing formed of metal material, a rear housing formed of metal material, a base, upper and lower holding plates, and a case formed of plastic material, wherein the body comprises a forward extension and two sidewalls each including an upper groove extended toward the extension, a lower opening with either positioning device fastened in the upper groove and the lower opening, and two outer recesses each adjacent the upper groove or the lower opening with ends of the upper holding plate fastened in the upper ones of the recesses and ends of the lower holding plate fastened in the lower ones of the recesses. In an assembly of the present invention, first, insert the second conductors into the case. Then insert the first conductors into the channels in the receiving space of the insulating body for fastening. Next, insert the positioning devices through the receptacle with the bodies tightly received in the grooves. The narrow portions of the positioning members are inserted into the openings with the toothed sections fastened at mated teeth in the openings. At this position, the positioning devices are fastened. Insert the base into a well defined by the sidewalls with the electrical terminals of the first conductors passed the channels. Ends of the conductors are positioned on the valleys. Next, solder the ends of the first conductors and the ends of the second conductors to electrically couple them together. Put the holding plates onto the base with the tabs inserted into the indentations and the detents inserted into the recesses. As such, the holding plates are secured to the insulating body. The holding plates are provided for fastening the positioning devices and only the upper holding plate is additionally adapted to protect the soldered portions of the first and second conductors. Put the front housing on the insulating body with the extension received in the sheath. Also, the hooks are inserted through the openings to project from the top surface of the sheath. Next mount the rear housing onto the receptacle with the protrusions projected from the openings. Pour liquid solder into the U-shaped indentations. The solder next flows to the trough. Once cured, the front and rear housings are fastened together by the solder. This can effect a high quality signal transmission by protecting the soldered portions of the first and second conductors and substantially eliminate EMI during operation. Finally, insert the above assembled components into the case prior to finishing the assembly by sleeving the shroud onto the sheath to project the hooks from the openings of the shroud. To the contrary, for disassembly, simply press a top latch of the case to urge against the protrusions to disengage the hooks from the openings of the shroud.

The above and other objects, features and advantages of the present invention will become apparent from the following detailed description taken with the accompanying drawings.

DETAILED DESCRIPTION OF THE PREFERRED EMBODIMENTS

Figure 1:
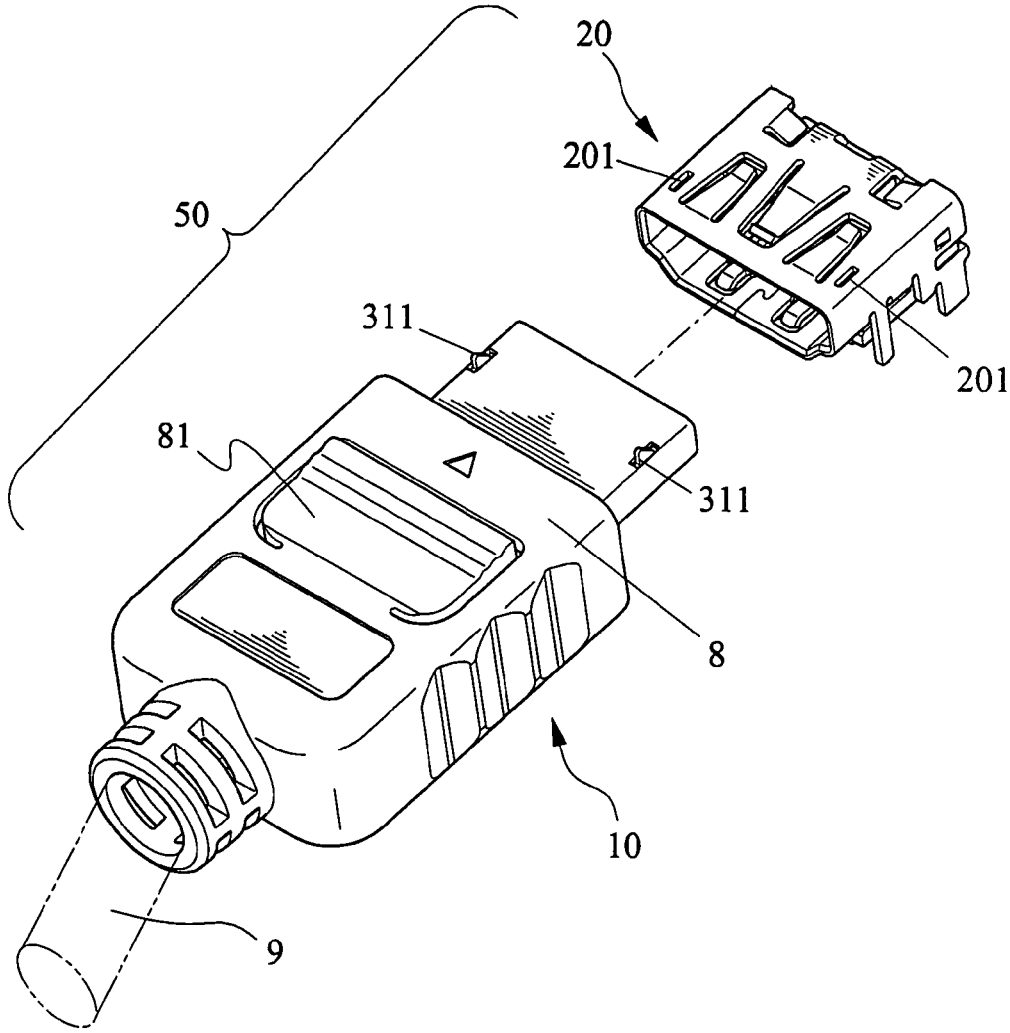
FIG. 1 is an explode perspective view of a preferred embodiment of electrical connector assembly according to the invention.
Figure 2:
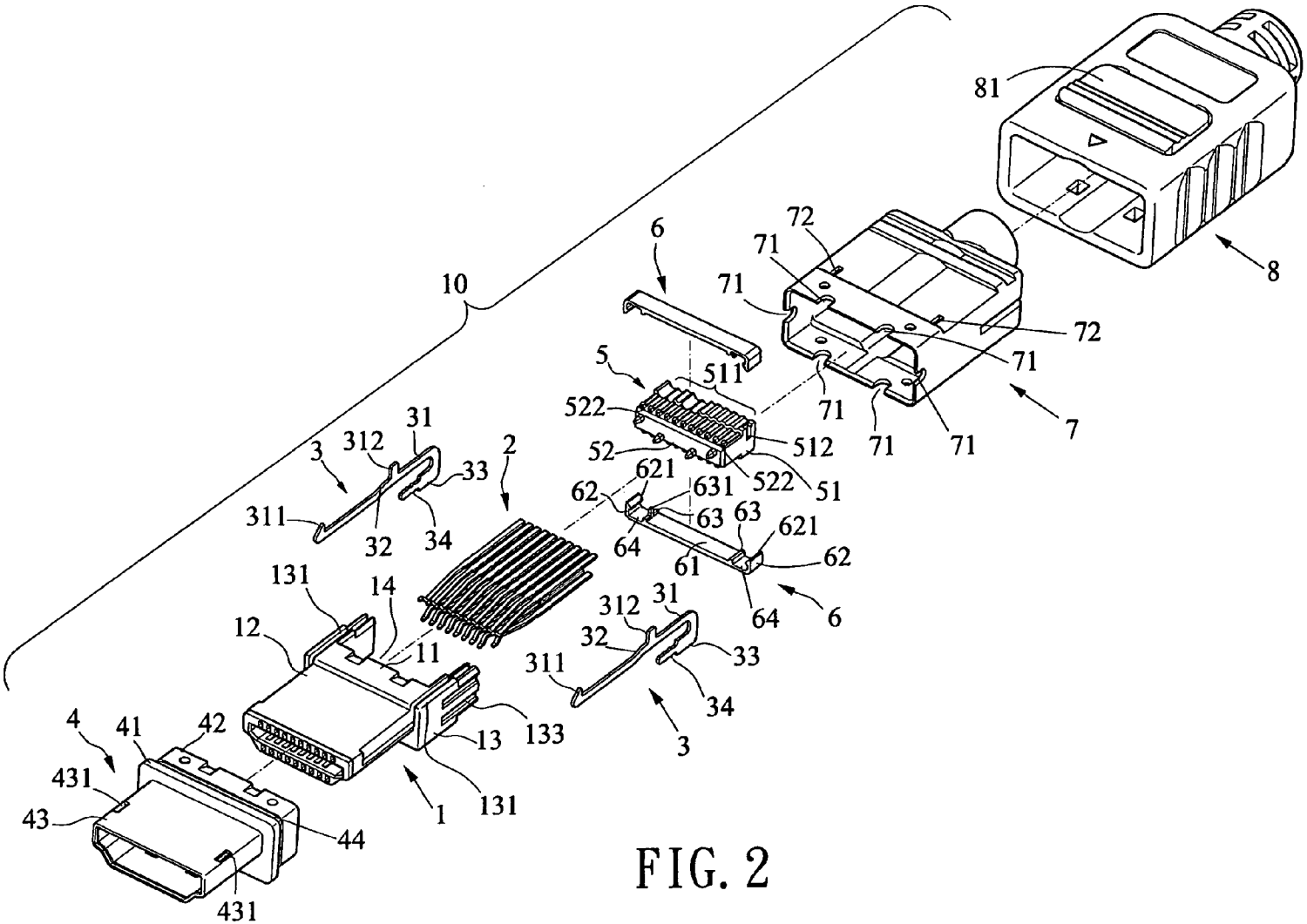
FIG. 2 is an exploded view of the electrical connector shown in FIG. 1.
Figure 3:
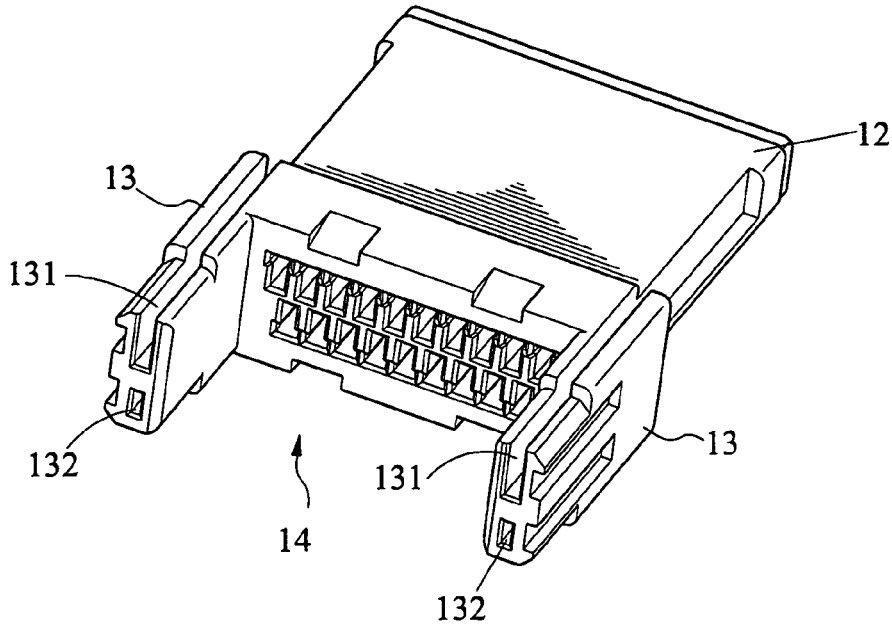
FIG. 3 is a perspective view of the assembled extension and sidewalls.

Referring to FIGS. 1 to 6, there is shown a HDMI electrical connector assembly 50 including a HDMI connector 10 and a HDMI shroud 20 constructed in accordance with a preferred embodiment of the invention.

The parallelepiped connector 10 comprises an insulating body 1, a plurality of parallel conductors 2, two positioning devices 3, a metal front housing 4, a metal rear housing 7, a base 5, two holding plates 6, and a plastic case 8. Each component will be described in detailed below. The insulating body 1 comprises a rear receptacle 11 having two sidewalls 13, and a forward extension 12. The sidewall 13 comprises an upper groove 131 extended toward the extension 12, a lower opening 132, and two outer recesses 133 each adjacent the groove 131 or the opening 132.

The conductors 2 are well known elements. Thus, a detailed description thereof is omitted herein for the sake of brevity. The positioning device 3 comprises an upper, elongated body 31 and a lower, parallel, short positioning member 33 formed by bending the body 31. The body 31 comprises a forward arcuate section 32, a hook 311 at its end, and a protrusion 312 proximate the arcuate section 32. The positioning member 33 comprises a wide portion for positioning and a narrow portion having toothed section 34 on top and bottom portion thereof for being inserted into the lower opening 132 for fastening.

The parallelepiped base 5 comprises a body 51 and a forward slightly tapered projection 52. A plurality of parallel valleys 511 are formed on either top or bottom of the body 51 with conductors 9 rested thereon. An indentation 512 is formed on either side in which one indentation 512 is on an upper portion and the other is on a lower portion. The projection 52 comprises a plurality of channels 522 on either top or bottom surface with the conductors 2 passed.

The holding plate 6 is an elongated member and comprises a body 61 and two end walls 62 formed by bending. A detent 621 is provided at an end of the wall 62 inserted into the recess 133 for fastening. Two ridges 63 are provided on an inner surface of the body 61 so as to form a tunnel 64 between the ridge 63 and the wall 62. The tunnel 64 has a width substantially the same as that of the sidewall 13. Also, there is provided a tab 631 on one ridge 63 for inserting into one indentation 512. Note that the tab 631 of the upper holding plate 6 is not symmetric with respect to that of the lower holding plate 6.

The front housing 4 is shaped to receive the extension 12 and comprises a front projected sheath 43 having an opening 431 at either end with the hook 311 inserted through for fastening. The front housing 4 further comprises an intermediate peripheral flange 41, a rear rectangular frame 42, and a trough 44 in a juncture of the flange 41 and the frame 42. The flange 41 and the trough 44 are provided for positioning when the case 8 is put on. The rear housing 7 is a hollow parallelepiped and comprises a plurality of U-shaped indentations 71 around a forward edge and two rectangular openings 72 on a top surface. The hollow, parallelepiped case 8 is shaped to receive the rear housing 7 and the frame 42, the trough 44, and the flange 41 of the front housing 4. A cantilever latch 81 is formed on a top of the case 8.

Figure 4:
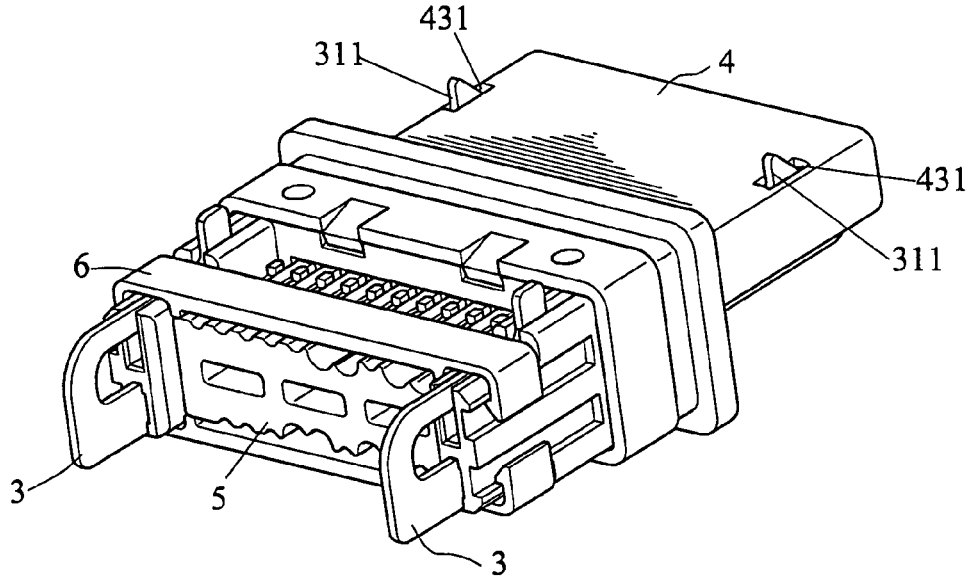
FIG. 4 is a perspective view of the half assembled connector.
Figure 5:
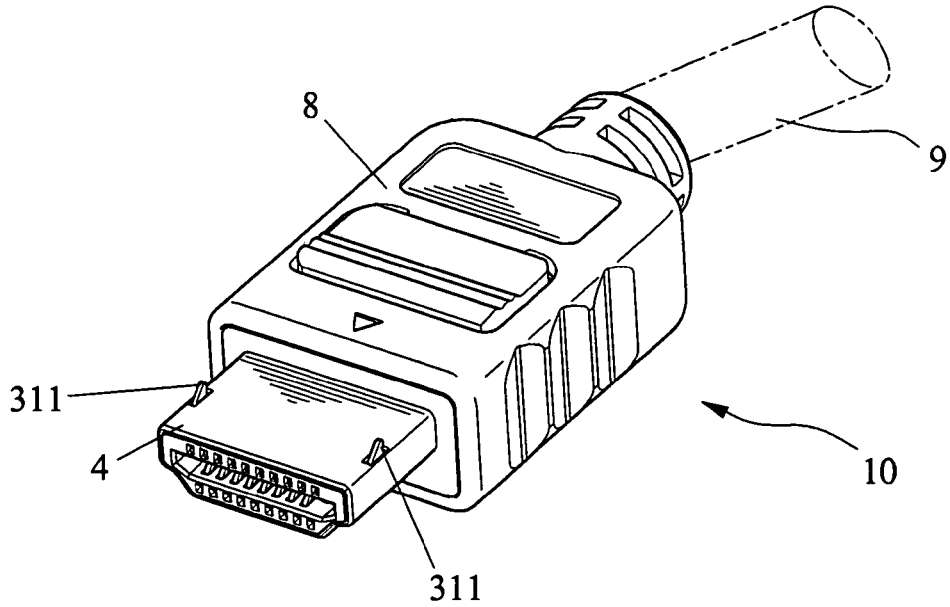
FIG. 5 is a perspective view of the assembled connector.
Figure 6:
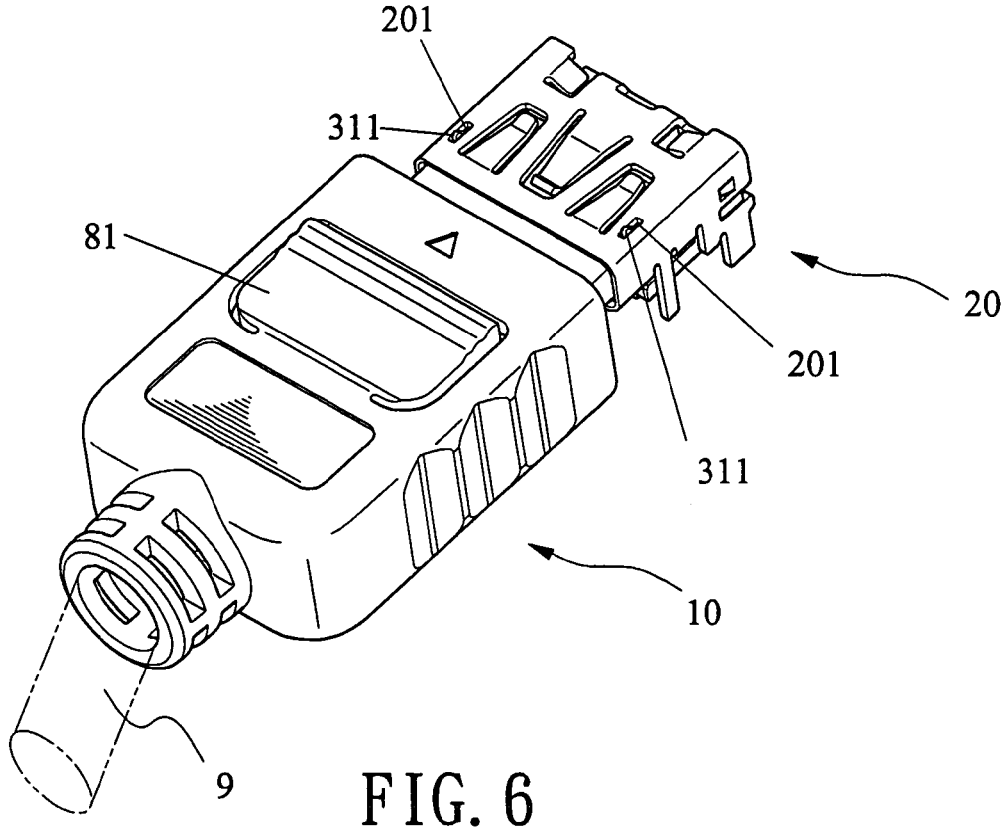
FIG. 6 is a perspective view of the assembled electrical connector assembly.

Referring to FIGS. 4 to 6 specifically, an assembly of the invention will be described in detailed below. First, insert the conductors 9 into the case 8. Then insert the conductors 2 into the channels in the receiving space of the insulating body 1 for fastening. Next, insert the positioning devices 3 through the receptacle 11 with the bodies 31 tightly received in the grooves 131. The narrow portions of the positioning members 33 are inserted into the openings 132 with the toothed sections 34 fastened at mated teeth in the openings 132, as shown in FIG. 4. At this position, the positioning devices 3 are fastened. Insert the base 5 into a well 14 defined by the sidewalls 13 with the electrical terminals of the conductors 2 passed the channels 522. Ends of the conductors 9 are positioned on the valleys 511. Next, solder the ends of the conductors 2 and the ends of the conductors 9 to electrically couple them together. Put holding plates 6 onto the base 5 with the tabs 631 inserted into the indentations 512 and the detents 621 inserted into the recesses 133. As such, the holding plates 6 are secured to the insulating body 1. The holding plates 6 are provided for fastening the positioning devices 3 and only the upper holding plate 6 is additionally adapted to protect the soldered portions of the conductors 2 and 9. Put the front housing 4 on the insulating body 1 with the extension 12 received in the sheath 43. Also, the hooks 311 are inserted through the openings 431 to project from the top surface of the sheath 43. Next mount the rear housing 7 onto the receptacle 11 with the protrusions 312 projected from the openings 72. Pour liquid solder into the U-shaped indentations 71. The solder next flows to the trough 44. Once cured, the front housing 4 and the rear housing 7 are fastened together by the solder. This can effect a high quality signal transmission and substantially eliminate EMI (electromagnetic interference) during operation. Finally, insert the above assembled components into the case 8 prior to sleeving the HDMI shroud 20 onto the sheath 43 for finishing the assembly. For disassembly, press the latch 81 to urge against the protrusions 312 to disengage the hooks 311 from openings 201 of the HDMI shroud 20. For assembling HDMI shroud 20 and the HDMI connector 10, simply put the shroud 20 onto the sheath 43 to project the hooks 311 from the openings 201.

While the invention herein disclosed has been described by means of specific embodiments, numerous modifications and variations could be made thereto by those skilled in the art without departing from the scope and spirit of the invention set forth in the claims.

What is claimed is:

1. An electrical connector assembly comprising:

a shroud; and a connector including an insulating body having a forward extension, a plurality of parallel first conductors, two positioning devices, a front housing formed of metal material with the shroud securely put thereon, a rear housing formed of metal material, a base, upper and lower holding plates, and a case formed of plastic material, wherein the body further comprises two sidewalls each including an upper groove extended toward the extension, a lower opening with either positioning device fastened in the upper groove and the lower opening, and two outer recesses each adjacent the upper groove or the lower opening with ends of the upper holding plate fastened in the upper ones of the recesses and ends of the lower holding plate fastened in the lower ones of the recesses.

2. The electrical connector of claim 1, wherein either positioning device comprises an upper, elongated body and a lower, parallel, short positioning member formed by bending the body thereof, the body of the positioning device comprises a forward arcuate section, a hook at its end, and a protrusion proximate the arcuate section, and the positioning member comprises a wide portion and a narrow portion having a toothed section on a top and a bottom.

3. The electrical connector of claim 1, wherein the base comprises a substantially parallelepiped body including a plurality of parallel valleys formed on either a top or a bottom thereof with a plurality of second conductors rested thereon, an indentation formed on either side thereof, and a plurality of channels on either a top or a bottom thereof with the first conductors passed.

4. The electrical connector of claim 1, wherein either holding plate is an elongated member and comprises a body, two end walls formed by bending, and two detents each formed at an end of the end wall fastened in the recess.

5. The electrical connector of claim 4, wherein either holding plate further comprises two ridges formed on an inner surface thereof, two tunnels each formed between the ridge and the end wall, the tunnel having a width substantially the same as that of the sidewall, and a tab formed on one ridge.

6. The electrical connector of claim 2, wherein the front housing comprises a front projected sheath having an opening at either end with the hook inserted through, an intermediate peripheral flange, a rear rectangular frame, and a trough in a juncture of the flange and the frame.

7. The electrical connector of claim 6, wherein the rear housing is a hollow parallelepiped and comprises a plurality of U-shaped indentations around a forward edge and two rectangular openings on a top surface with the protrusions projected therefrom.

8. The electrical connector of claim 2, wherein the shroud comprises two top openings with the hooks projected therefrom.

* * * * *